US011456545B2

(12) United States Patent
Sobina et al.

(10) Patent No.: US 11,456,545 B2
(45) Date of Patent: Sep. 27, 2022

(54) BROADBAND DIRECTED DUAL-BAND ANTENNA WITH DOUBLE POLARIZATION

(71) Applicant: Kroks Plus LLC, Voronezh (RU)

(72) Inventors: Vadim Petrovich Sobina, Alekseevka (RU); Maksim Viktorovich Dakhin, Voronezh (RU)

(73) Assignee: Kroks Plus LLC, Voronezh (RU)

( * ) Notice: Subject to any disclaimer, the term of this patent is extended or adjusted under 35 U.S.C. 154(b) by 7 days.

(21) Appl. No.: 17/156,580

(22) Filed: Jan. 24, 2021

(65) Prior Publication Data

US 2021/0234285 A1 Jul. 29, 2021

(30) Foreign Application Priority Data

Jan. 27, 2020 (RU) ..... RU2020103536

(51) Int. Cl.
*H01Q 21/30* (2006.01)
*H01Q 1/42* (2006.01)
*H01Q 15/14* (2006.01)

(52) U.S. Cl.
CPC ..... *H01Q 21/30* (2013.01); *H01Q 1/42* (2013.01); *H01Q 15/14* (2013.01)

(58) Field of Classification Search
CPC ..... H01Q 21/30; H01Q 1/42; H01Q 15/14
USPC ..... 343/725
See application file for complete search history.

(56) References Cited

U.S. PATENT DOCUMENTS

2015/0102971 A1* 4/2015 Liu ..... H01Q 1/246 343/797
2020/0212533 A1* 7/2020 Yang ..... H01Q 1/40

FOREIGN PATENT DOCUMENTS

RU 2012 154 791 A 10/2014
RU 172 803 U1 7/2017
RU 180 322 U1 6/2018
WO WO 2013/000069 A1 1/2013

* cited by examiner

*Primary Examiner* — Peguy Jean Pierre
(74) *Attorney, Agent, or Firm* — Aslan Law, P.C.

(57) ABSTRACT

The utility model belongs to the antenna equipment. The broadband directed dual-band antenna with double polarization comprising active vibrators of the lower frequency band and vibrators of the higher frequency band, the vibrators arms having the same polarization that coincide with the vibrators arms of orthogonal polarization, at least two symmetrizing devices, two coaxial inputs and outputs or high-frequency transmission lines, a reflector. The effect of the utility model is the expansion of range of operating frequencies of the antenna.

6 Claims, 2 Drawing Sheets

BROADBAND DIRECTED DUAL-BAND ANTENNA WITH DOUBLE POLARIZATION

CROSS-REFERENCE TO RELATED APPLICATIONS

This application claims priority to RU Patent Application No. 2020103536 filed on Jan. 27, 2020, the entire contents of which are hereby incorporated by reference.

DETAILED DESCRIPTION

Figure 1:
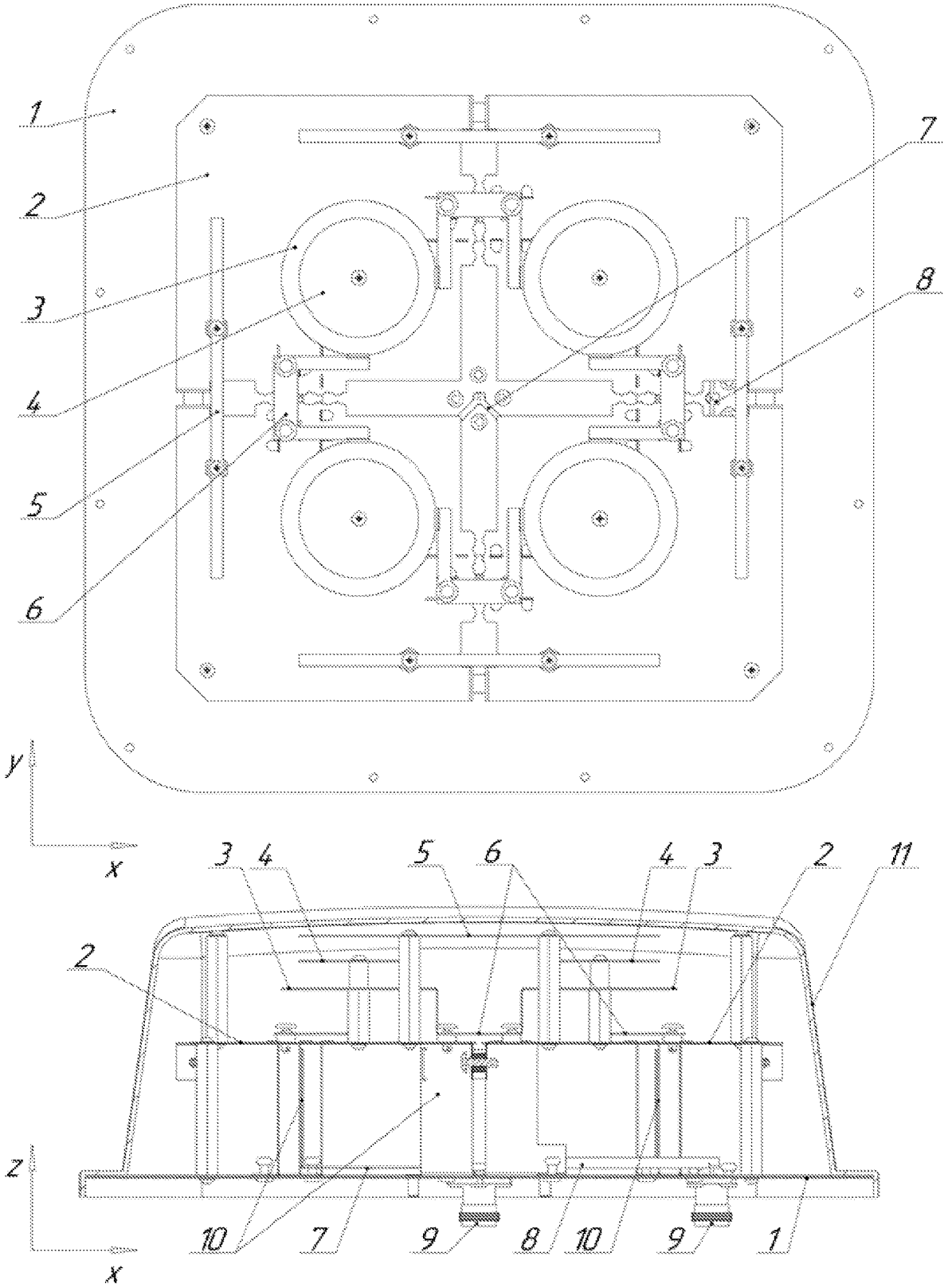
FIG. 1 is the general view of an antenna.

This utility model belongs to the antenna equipment and can be used for the amplification of signals of cellular communication and in the data transmission systems as the subscriber antenna or as an element of an antenna lattice of the base station antenna.

At present the broadband directed dual-polarizing antenna is known (utility model patent RU 180322 model, published on Jun. 8, 2018) containing, at least, two pairs of vibrators, where the planes of polarization of these pairs of vibrators are perpendicular, and the vibrator arms of one polarization coincide with vibrators arms of other polarization and are located over the general reflector, and the symmetric transmission lines feeding them are at the same height from a reflector and are connected with coaxial inputs of the antenna by means of the symmetrizing devices.

The broadband directed antenna with double polarization is known (utility model patent RU 172803 published on Mar. 27, 2017). This device contains two antennas with linear polarization having the common screen, each of them consists of at least two active vibrators, and the arms of active vibrators of one antenna are the arms of active vibrators of the second antenna, the distinguished feature is that the power supply circuits of the vibrators of each antenna are the pieces of a two-wire transmission line connecting the inputs of the vibrators and an asymmetrical transmission line.

The prior art is the broadband directed antenna with double polarization (utility model patent RU 169151 model published on Mar. 7, 2017). The antenna consists of two antennas with linear polarization, each of them consists of active vibrators, the screen, feeding coaxial line, the distinguished feature is that each antenna with linear polarization consists of at least two active vibrators where the arms of active vibrators of one antenna are the arms of active vibrators of the second antenna, and at least, of two symmetrizing transformers connected to active vibrators.

The disadvantage of the prior art devices is the insufficiently wide range of their working frequencies by modern requirements of high-speed data transmission.

Technical problem of the utility model is the creation of the technological small-sized directed antenna with double polarization having a high gain and a high decoupling between the antenna inputs in two subsequently wide ranges of frequencies.

The technical result of the utility model is the essential expansion of the operating frequency band of the double polarization directed antenna with high gain in comparison with the existing equipment level.

To achieve the specified technical result the antenna is offered consisting of four pairs of vibrators where two pairs of vibrators of the lower frequency band are located over the common conducting reflector so that the polarization planes of these pairs of vibrators are mutually perpendicular and arms of the vibrators pair of the same polarization coincide with the arms of the vibrators pair of different polarization and represent at the same time the reflector for the other two vibrator pairs of the higher frequency band which is located over them so that the polarization planes of these vibrators pairs are also perpendicular and the arms of the vibrators pair having the same polarization coincide with the arms of the pair Of the vibrators of different polarization. The arms of vibrators of the lower frequency band are connected in pairs to two coaxial inputs of the antenna fixed on the common reflector by means of four symmetrizing devices and microstrip transmission lines. The arms of the vibrators of the higher frequency band are mutually connected by the strip transmission lines feeding them and crossing a gap between the vibrator arms of the lower frequency band adjacent to their points of connection with the symmetrizing devices. The antenna may contain also the passive vibrators of the lower and high frequency band located over their corresponding active vibrators. The arms of the vibrators of the lower and higher frequency band and passive vibrators can be fixed on the reflector or on a dielectric casing by means of dielectric racks, and the passive vibrators can be fixed in the points of zero potential and by means of the conducting racks.

With purpose to increase the technological effectiveness of the antenna production, the reflector, active and passive symmetrizing devices of the vibrators with microstrip lines feeding them can be made of metal sheet by the same processing technique with subsequent bending, and each pair of symmetrizing devices and the strip lines feeding them form a uniform component, the active vibrators of higher frequency band and the strip lines feeding them are also united as a single component made of metal sheet.

To protect the antenna reflector against the aggressive media the dielectric radiotransparent casing made of radiating elements can be fixed, otherwise the antenna can be placed in the case made of a dielectric material as a whole.

Figure 2:
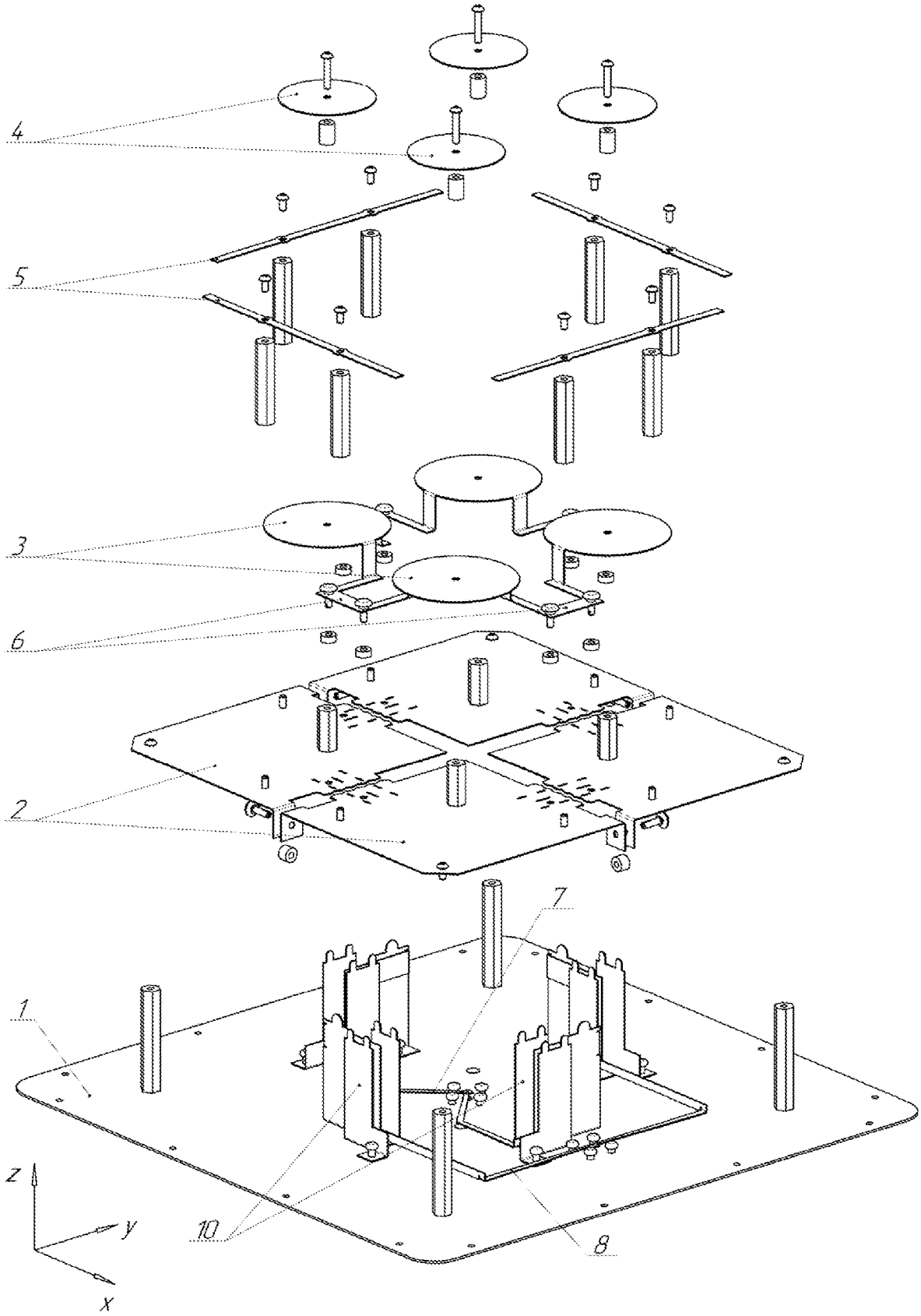
FIG. 2 is the detailed view of the antenna.

The device comprising the novel utility model will be disclosed using the drawings on which the optional antenna structure is shown, namely:

FIG. 1 is the general view of the antenna,

FIG. 2, is the detailed view of the antenna where its components are:

- 1—the bearing antenna reflector made of a conductive material;
- 2—the arm of the vibrator of lower frequency band;
- 3—the arm of the vibrator of higher frequency band;
- 4—passive vibrator of higher frequency band;
- 5—passive vibrator of lower frequency band;
- 6—a strip line feeding the vibrators of the higher frequency band;
- 7, 8—microstrip lines feeding the symmetrizing devices;
- 9—coaxial inputs of the antenna;
- 10—symmetrizing devices;
- 11—a protection cover of the antenna made of a radiotransparent material.

Let's consider the example of the invented antenna structure shown on FIG. 1 and FIG. 2. As shown here, four vibrator arms 2 of the lower frequency band are placed symmetrically on the dielectric racks of the corresponding height above the reflector 1 with the size equal approximately to ($\lambda H_{ч} \times \lambda H_{ч}$) where $\lambda H_{ч}$ is the wavelength at central frequency of the lower frequency band, four arms of 2 vibrators of the lower frequency band are fixed symmetrically in the same plane at the height of approximately 0.15

λH ч on the dielectric racks of the corresponding size are. The arms 2 are made in the form of metal plates with the dimensions of approximately (0.3 λH ч ×0.3 λH ч ) and can have various shape. The gap between the arms 2 is chosen by their best matching with the antenna input, in the example shown in FIGS. 1 and 2 it is equal to approximately 0.045 λH ч . The vibrator arms 2 are connected in pairs to four symmetrizing transformers 10 so that each pair of the vibrator arms 2 forms the wide-band linear polarization dipole with one of the symmetrizing transformers 10. The symmetrizing transformers 10 are the short-circuited bridges installed on the bearing reflector 1, they are connected in pairs with the microstrip lines 7 and 8 to the coaxial inputs of the antenna 9. To expand the lower frequency band, passive vibrators 5 that are the narrow metal plates with the length of approximately 0.4 λH ч are installed over each four half-wave dipoles formed by the arms 2 at a height of 0.11 λH ч .

To provide the operation of the antenna in the higher frequency band, the conductive vibrators 3 are installed at height of approximately 0.15 λB ч over the vibrators arms 2 on the dielectric holders, these conductive vibrators 3 have the shape of disks with the diameter of approximately 0.42 λB ч where λB ч is the wavelength at the central frequency of the higher frequency band. Vibrators 3 are connected with each other by the strip lines 6 passing adjacent to the connection points of the symmetrizing devices 10 and the vibrator arms 2 at a distance from the arms 2 equal approximately to 0.02 λB ч . To expand the effective frequency range, the disk-shaped passive vibrators 4 with the diameter of approximately 0.33 λB ч are fixed on the holders above the centers of vibrators 3 at a distance between them of approximately 0.07 λB ч . These vibrators 3 and 4 can have various shape. To protect the elements of the antenna, the dielectric casing 11 is installed onto the reflector 1.

The principle of operation of the antenna in one of YOZ polarization planes is as follows: when a high-frequency signal is applied to one of the coaxial inputs of antenna 9 connected to the microstrip line 7, the signal power is distributed equally and is fed equally to two symmetrizing devices 10 connected to microstrip line 7 and then to the inputs of the active vibrators of the lower frequency band formed by the vibrator arms 2, where it excites high frequency currents. As a result, the pair of active half-wave vibrators formed by arms 2 is fed in the common mode by phase and together with two passive vibrators 5 and the reflector 1 in parallel to those it excites the radiation with linear polarization parallel to axis Y, mainly in the direction of axis Z. In the higher frequency band the high-frequency currents directed along the gap between the vibrators arms 2 form a high tension field inside the gap area which in turn excites the high frequency currents in the conductors 6 that cross this gap and feed the vibrators 3. As a result, the vibrators 3 are also powered from conductors 6 in the common mode and together with passive vibrators 4 and the vibrator arms 2 as a reflector they, also form the radiation with linear polarization parallel to axis Y, mainly in the direction of axis Z.

The antenna works similarly in the orthogonal polarization in the XOZ plane from other coaxial input 9, involving the microstrip line 8 and the second pair of symmetrizing devices 10.

As a result, the antenna is capable to form radiation in one direction, but with mutually orthogonal polarization. Due to this, the broadband directed dual-band antenna can be operated with double polarization simultaneously with two receivers or two transmitters and ensure the functioning of a communication systems which utilize both the polarizing and frequency division of the distribution channels of radio waves. This system can be used also in anti-feeding systems with a polarizing separation of antennas.

The example of the antenna design shown above allowed to achieve the following main technical characteristics:

- operation frequency bands: 698-960 MHz, 1700-2700 MHz;
- gain in the specified frequency bands: 9.3 . . . 9.7 dB, 13.2 . . . 15.0 dB;
- standing wave coefficient in the specified frequency bands: 2 or less;
- isolation between the antenna inputs in the specified frequency bands: 40 dB or less;
- dimensions of the antenna of 300×300×100 mm.

What we claim is:

1. A broadband directed dual-band antenna with double polarization consisting of active vibrators of an lower frequency band and vibrators of a higher frequency band, the broadband directed dual-band antenna comprising:

at least two symmetrizing devices connected to the active vibrators;

feeding high-frequency transmission lines; and a reflector, wherein the vibrator arms of the same polarization coincide with the vibrator arms with orthogonal polarization, the vibrator arms of a lower frequency range combine the function of the reflector and a slotted coupling radiator for the vibrator arms of an upper frequency range, and the lower frequency range and the upper frequency range have one common input.

2. The broadband directed dual-band antenna with double polarization according to claim 1, further comprising:

at least four passive vibrators.

3. The broadband directed dual-band antenna with double polarization according to claim 1, further comprising:

a dielectric casing or is installed into the dielectric case entirely.

4. The broadband directed dual-band antenna with double polarization according to claim 1, wherein the reflector, the active and passive vibrators, the symmetrizing devices with the microstrip lines feeding them can be manufactured of sheet metal in the same processing cycle.

5. The broadband directed dual-band antenna with double polarization according to claim 1, wherein the symmetrizing devices and the transmission lines feeding them are combined in one unit.

6. The broadband directed dual-band antenna with double polarization according to claim 1, wherein the active vibrators of the higher frequency band and the strip lines feeding them are combined in one unit.

* * * * *